US007370641B2

(12) United States Patent
Zuchara et al.

(10) Patent No.: US 7,370,641 B2
(45) Date of Patent: May 13, 2008

(54) MONOLITH RETAINER

(75) Inventors: Pawel Zuchara, Michalowice (PL); Jaroslaw Ziolkowski, Kielce (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/638,194

(22) Filed: Dec. 13, 2006

(65) Prior Publication Data

US 2007/0228724 A1 Oct. 4, 2007

(30) Foreign Application Priority Data

Apr. 3, 2006 (EP) ..... 06270037

(51) Int. Cl.
*F02M 33/02* (2006.01)

(52) U.S. Cl. ..... 123/519; 123/518; 55/385.3

(58) Field of Classification Search ..... 123/516, 123/518, 519; 55/385.3, 385.4
See application file for complete search history.

(56) References Cited

U.S. PATENT DOCUMENTS 3,817,714 A * 6/1974 Wiley ..... 422/173
4,381,583 A * 5/1983 von Tiesenhausen ..... 24/594.1
6,350,291 B1 * 2/2002 Gieseke et al. ..... 55/385.3

FOREIGN PATENT DOCUMENTS

WO WO 2005095781 A1 * 10/2005

* cited by examiner

*Primary Examiner*—Stephen K. Cronin
*Assistant Examiner*—J. Page Hufty
(74) *Attorney, Agent, or Firm*—Patrick M. Griffin

(57) ABSTRACT

The invention relates to a monolith retainer for a fuel canister. The retainer has a head portion for retaining a monolith within a chamber of the fuel canister and a plurality of resiliently biased leg members, which extend from the head portion along a length of the monolith being retained. The legs are resiliently biased toward the inner wall of the chamber such that, when the monolith resides within the chamber, contact feet of the resiliently biased leg members abut against the monolith. A support ridge is also provided for preventing the monolith from traveling too far into the canister.

12 Claims, 4 Drawing Sheets

MONOLITH RETAINER

TECHNICAL FIELD OF INVENTION

The present invention relates to a monolith retainer, particularly, but not exclusively for use in retaining a monolith in position within a fuel canister of an automobile.

BACKGROUND OF INVENTION

Automobiles are typically provided with fuel canisters for reducing vapour emission from the fuel tank. This is often achieved using a carbon based monolith which is placed in line with the canister in order to adsorb vapours from the fuel tank. Such monoliths may be located remotely from the canister and connected via a pipe or may be installed in a suitable chamber integrated into the canister body.

In order to secure the monolith within the integrated chamber and to ensure that vapour flows through the monolith (rather than around it) it is typically sandwiched between a pair of rubber seal plugs. However, the material required for these seals to retain the monolith securely and to ensure a sufficient seal to the vapour, is relatively expensive. Furthermore, the monolith (which is typically manufactured from a brittle material) is easily damaged during insertion into the chamber.

Another problem with current monolith chamber arrangements is that, once in position, a resilient compensation system typically compresses the monolith arrangement from above. This can cause undesirable axial movement of the monolith within the chamber after manufacture of the fuel canister.

SUMMARY OF THE INVENTION

According to the present invention there is provided a monolith retainer having a head portion for retaining a monolith within a chamber, at least one resiliently biased leg member which extends from the head portion along a length of the monolith and is resiliently biased toward the inner wall of the chamber such that when the monolith resides within the chamber at least a portion of the resiliently biased leg member abuts against a portion of the outer surface of the monolith.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

Embodiments of the present invention will be further described with reference to the accompanying drawings in which.

DETAILED DESCRIPTION OF INVENTION

In the following description the term "vapour end" is used to describe the end of the monolith closest to the vapour supply from the fuel tank, and the term "air end" describes the end of the monolith closest to the adsorbed output from the monolith.

Figure 1:
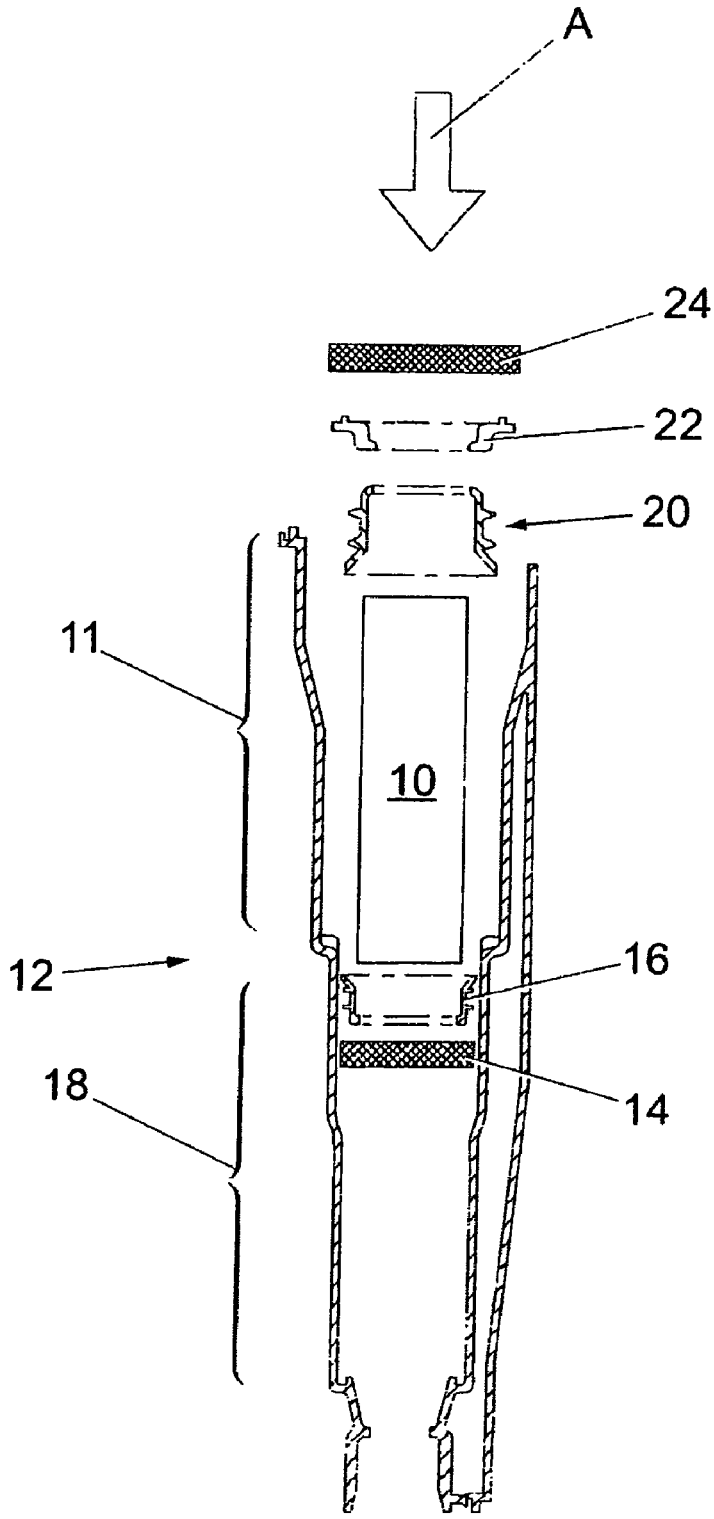
Fig. 1 (PRIOR ART)
FIG. 1 is a transverse partial cross sectional diagram illustrating the installation of a monolith into the monolith chamber using prior art sealing plugs.

Referring to FIG. 1, in prior art canisters, the monolith 10 is inserted into a monolith chamber 12 by pushing it in the direction indicated by arrow A. The monolith chamber 12 has an upper section 11 and a lower, relatively small diameter section 18. A filter 14 and seal 16 are placed at the air end of the monolith 10 during insertion. Once in position, the seal 16 ensures that no gases (vapour/air) may pass from the upper section 11 and out of the lower section 18 without having passed through the monolith 10. Once in position in the lower section 18 of the chamber 12, the air end of the monolith 10 sits in the seal 16 body and is discouraged from being pushed out of the bottom of the lower section 18 due a gradual taper in the walls of the lower section 18. A further seal 20 is simultaneously pushed onto the vapour end of the monolith 10. The seal 20 ensures that no vapour may pass from the upper section 11 and into the annulus between the monolith 10 and the inner walls of the lower chamber 18. The seal 20 also retains the monolith 10 in the lower portion 18 of chamber 12 against the seal 16. In order to prevent carbon from entering the monolith, a plate 22 is also inserted on top of the seal 20. A screen 24 is then placed on top of this arrangement.

A problem with the prior art arrangement of FIG. 1 is that in order to ensure that the monolith is held securely in place within the lower section 18 of the monolith chamber 12, it must be pushed in firmly. However, the tapered nature of the lower section 18 walls allows the seal 20 to be pushed too far into the monolith chamber 12. This can jam the monolith into the lower section 18 and often results in damage to the monolith 10 and/or the seals 16, 20 resulting in a decrease in performance of the resulting canister arrangement. Furthermore, although the gradual taper in the walls of the lower section discourage the monolith from being pushed further into the monolith chamber, over time it may do so due to the resilience provided by compensation systems typically used to compress such monolith arrangements.

Figure 2:
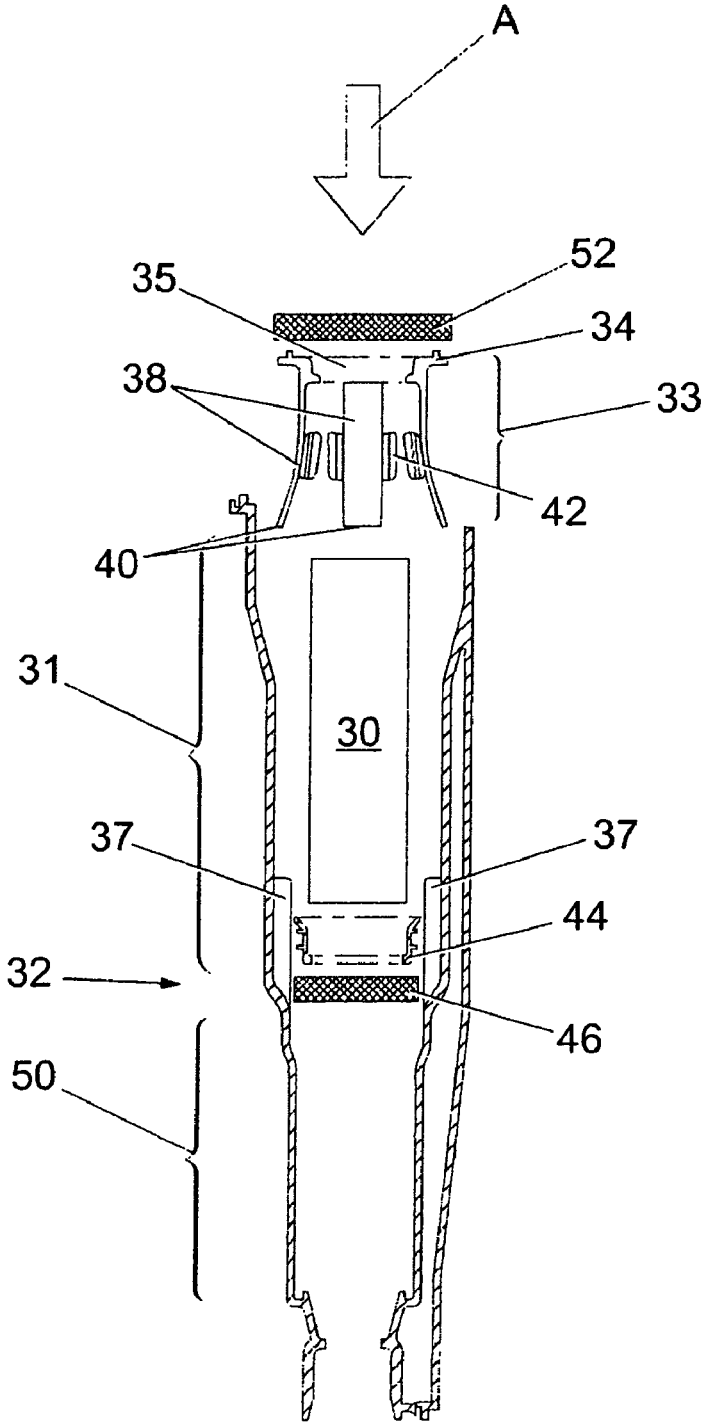
FIG. 2 is a transverse partial cross sectional diagram illustrating the installation of a monolith into the monolith chamber using the monolith retainer according to the present invention.

Referring to FIG. 2, apparatus according to the present invention will now be described. It should be noted that the present embodiment requires minimal or no modification of the monolith chambers typically provided in current fuel canisters.

In the embodiment of the present invention shown in FIG. 2, the monolith retainer 33 has a circular head portion 34 (best illustrated in FIGS. 4 and 5) with a central hole 35 passing there through. Support struts 36 extend across the hole. Four resiliently biased elongate securing members in the form of legs 38 project downwardly and outwardly from the head portion 34 and are circumferentially spaced there around. Securing lips 40 flare outwardly from the end of the legs 38. Contact feet 42 also extend from the middle of each leg 38 toward the central axis of the monolith retainer 33.

The circular head portion 34, support struts 36, legs 38, lips 40 and contact feet 42 are all integrated into a simple component which may be manufactured from a suitably resilient plastic material.

The monolith chamber shown in FIG. 2 is also provided with a support ridge 37 at the lower inner circumference of upper section 31. Alternatively, an equivalent support could be provided by integrating support ridges into the monolith retainer 33.

Figure 4:
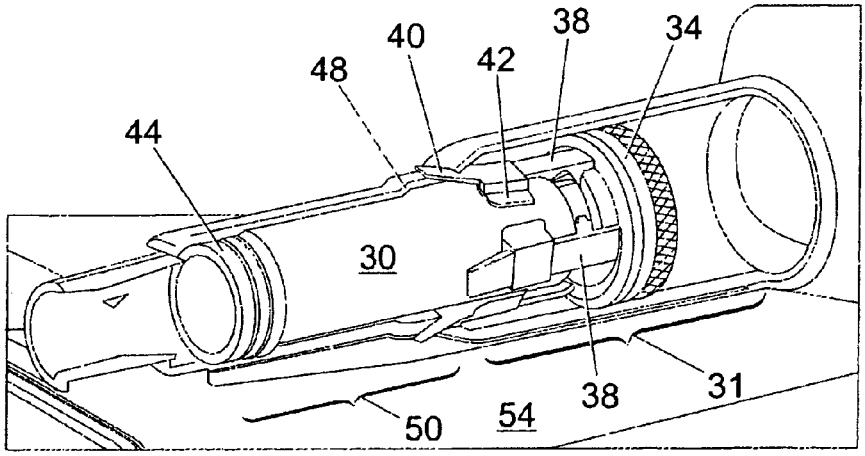
FIG. 4 is perspective partial cut-away view of the monolith of FIG. 3 from the end side of the monolith.
Figure 5:
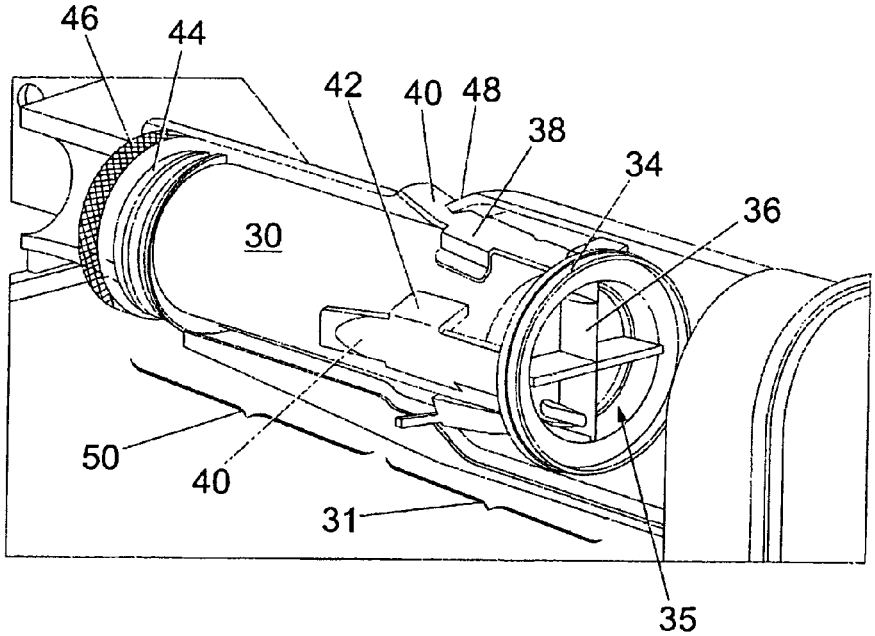
FIG. 5 is a perspective partial cut-away view of the monolith of FIG. 3 from the vapour end of the monolith.

When installing the monolith 30 into the monolith chamber of a fuel canister, the monolith retainer 33 is pushed in the direction indicated by arrow A on FIG. 2 against the monolith 30 seal 44 and filter 46. This causes the monolith 30 and seal 44 to progress from the upper section 31 to the lower section 50 of the monolith chamber 32 until the seal 44 and filter 46 are prevented from moving further down the lower section 50 past a pre-determined point (chosen to avoid damage of the monolith 30) by contact between the head portion 34 of the monolith retainer 33 and the support ridge 37. The lips 40 of the legs 38 are prevented from splaying outwards by the inner surface of the lower section 50 and all of the insertion force in the direction A is transferred to the monolith 30. At this point the contact feet 42 create a high level of frictional contact against the outer surface of the monolith and prevent it from moving relative to the monolith retainer 33. Once the filter 46 and seal 44 are prevented from moving further down the lower section 50, the monolith 30 is also prevented from traveling any further into the lower section 50. At the same time lips 40 align with recesses 48 provided in the monolith chamber lower section 50. The resilient nature of each lip 40 (which are an extension of legs 38) causes them to flare outwardly into each corresponding recess 48, as shown in FIGS. 4 and 5.

Figure 3:
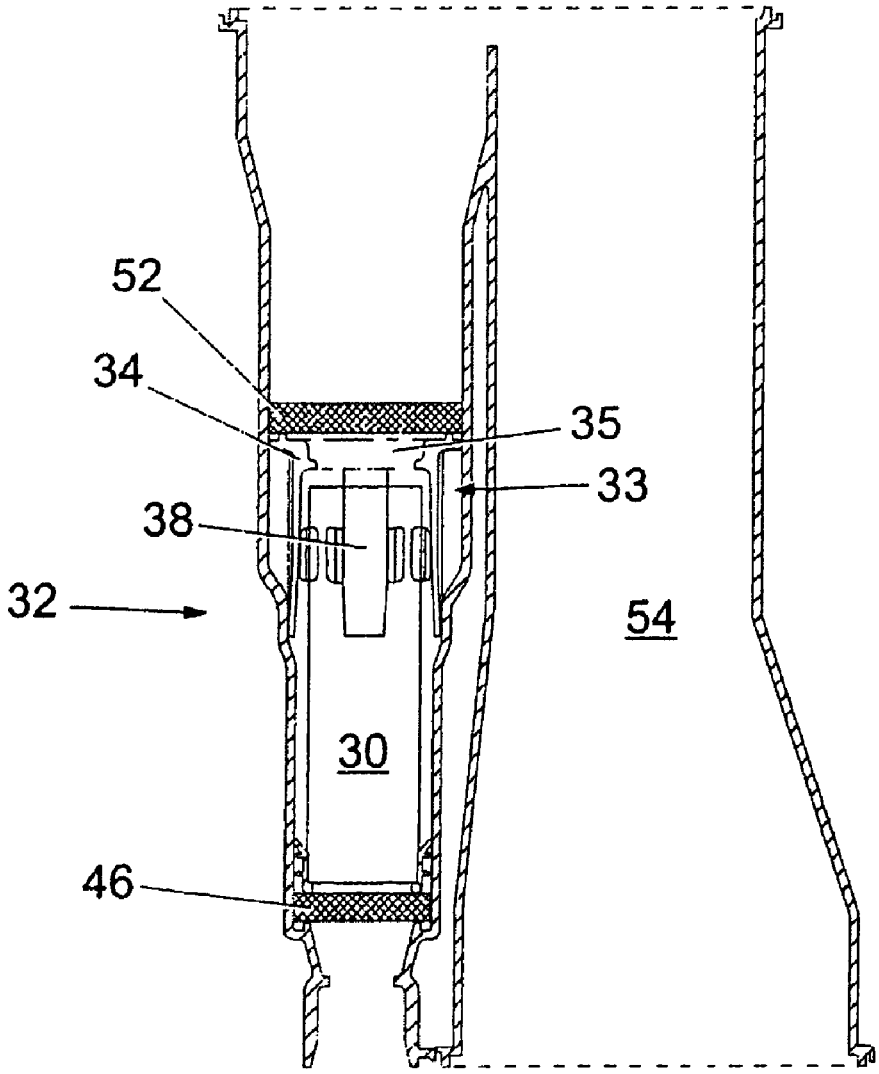
FIG. 3 is a transverse partial cross sectional view of the monolith of FIG. 2 installed in the canister.

The above described arrangement secures the monolith 30 within the lower section 50 of the monolith chamber 32. This is shown in FIG. 3 along with the typical location of the chamber 32 relative to the canister body 54. In this regard the contact feet 42 on each leg 38 also centralises the monolith 30 in the lower section 50.

An important feature of this arrangement is that any further application of force in the direction A will no longer result in any force being applied to the monolith 30 but will instead simply press the head portion 34 of the monolith retainer 33 against the support ridges 37. This prevents damage to the monolith 30/seal 44. Furthermore, the abutment of ridge 37 and head portion 34 spaces the head portion 34 from the lower section 50 when installed. Another effect of this arrangement is that the monolith retainer 33 and monolith 30 will not be moved further into the monolith chamber under the effect of spring compensation systems which are typically provided above the monolith.

Once in position, a screen 52 equivalent to screen 24 of the prior art may placed on top of the monolith retainer 33.

The circular head portion 34 may have a seal around its outer circumference in order to provide a sealing action equivalent to that provided by seal 20 of the prior art. However, such a seal is not essential since any flow of vapour from the fuel tank toward the monolith chamber can only escape there from by passing through the monolith 30 and out from the lower section 50. In this case, the skilled reader will note that recesses 48 should be enclosed to prevent any escape of vapour flow there from.

Modifications and improvements may be made to the foregoing, without departing from the scope of the present invention, for example:

Although four legs are circumferentially spaced around the monolith retainer in the embodiment shown, this may be altered to a minimum number in order to minimise the cost of producing the monolith retainer or may be increased to, for example, eight legs, in order to maximise the support provided by the monolith retainer whilst spreading the pressure exerted by the feet over a greater surface area of the monolith.

While this invention has been described in terms of the preferred embodiments thereof, it is not intended to be so limited, but rather only to the extent set forth in the claims that follow.

We claim:

1. A monolith retainer comprising:

a head portion for retaining a monolith within a chamber;

at least one resiliently biased leg member which extends from the head portion along a length of the monolith and is resiliently biased toward the inner wall of the chamber such that when the monolith resides within the chamber at least a portion of the resiliently biased leg member abuts against a portion of the outer surface of the monolith;

wherein the portion of the resiliently biased leg member which abuts against the monolith outer surface comprises a contact foot;

wherein the chamber has an inner wall provided with at least a recess such that when the monolith is retained within the chamber at least a portion of the resiliently biased leg member resides within the recess.

2. A monolith retainer according to claim 1, wherein a support ridge is provided on the chamber and is adapted to abut against the head portion when the monolith retainer is at a predetermined point.

3. A monolith retainer according to claim 1, wherein the head portion is disc-shaped and is provided with a plurality of leg members circumferentially spaced around the head member.

4. A monolith retainer according to claim 3, wherein the leg members correspond with a plurality of recesses provided in the chamber.

5. A monolith retainer according to claim 1, wherein the recess is enclosed in order to prevent vapour flow there through.

6. A monolith retainer according to claim 1, wherein the head portion is provided with an aperture which allows flow of vapour there through.

7. A monolith retainer according to claim 6, wherein the aperture comprises a substantially circular hole through the head portion, the diameter of the hole being smaller than the diameter of the monolith to be retained.

8. A monolith retainer according to claim 6, wherein at least a support strut extends across the aperture.

9. A monolith retainer according to claim 6, wherein the head portion is provided with a seal for sealing its outer edge against an inner wall of the chamber.

10. A monolith retainer according to claim 6, wherein said leg member has a first end connected to the head portion and a second end which flares outwardly to provide a retaining lip.

11. A monolith retainer according to claim 6, wherein the head portion and the leg member are formed from a single piece of resilient material.

12. A monolith retainer comprising:

a head portion for retaining a monolith within a chamber;

at least one resiliently biased leg member which extends from the head portion along a length of the monolith and is resiliently biased toward the inner wall of the chamber such that when the monolith resides within the chamber at least a portion of the resiliently biased leg member abuts against a portion of the outer surface of the monolith;

wherein the chamber has an inner wall provided with at least a recess such that when the monolith is retained within the chamber at least a portion of the resiliently biased leg member resides within the recess;

wherein the head portion is provided with an aperture which allows flow of vapour there through; and wherein the portion of the resiliently biased leg member which abuts against the monolith outer surface comprises a contact foot.

* * * * *